United States Patent [19]

Nakase et al.

[11] Patent Number: 4,999,089

[45] Date of Patent: Mar. 12, 1991

[54] CRACKING FURNACE

[75] Inventors: Noriaki Nakase, Urayasu; Mamoru Hokkedo, Yokohama; Etsuji Yamamoto, Ichihara; Masahiko Yoshida, Ichihara; Yutaka Kitayama, Ichihara, all of Japan

[73] Assignees: Mitsui Engineering & Shipbuilidng Co., Ltd.; Mitsui Petrochemical Industries, both of Tokyo, Japan

[21] Appl. No.: 413,734

[22] Filed: Sep. 28, 1989

[30] Foreign Application Priority Data

Sep. 30, 1988 [JP] Japan ..... 63-246149

[51] Int. Cl.[5] ..... C10G 9/20

[52] U.S. Cl. ..... 196/110; 196/116; 422/197; 422/204

[58] Field of Search ..... 422/196, 197, 204; 196/110, 116

[56] References Cited

U.S. PATENT DOCUMENTS

| | | | |
|---|---|---|---|
| 2,080,221 | 5/1937 | Florez | 196/110 |
| 2,127,815 | 8/1938 | Gullette | 196/110 |
| 2,151,386 | 3/1939 | Florez | 196/110 |
| 3,257,172 | 6/1966 | Kao et al. | 422/197 |
| 3,407,778 | 10/1968 | Hallee et al. | 196/116 |
| 3,469,946 | 9/1969 | Von Weisenthal | 422/204 |
| 3,672,847 | 6/1972 | Esselink | 422/197 |
| 4,405,564 | 9/1983 | Herbort et al. | 422/197 |

OTHER PUBLICATIONS

*Petrochemical Report*, "Millisecond Furnaces Can Increase Olefin Plant Profitability", Oil & Gas Journal, Apr. 6, 1981, pp. 121, 123, 124, 129, 130.

*Primary Examiner*—Joye L. Woodard

*Attorney, Agent, or Firm*—Fay, Sharpe, Beall, Fagan, Minnich & McKee

[57] ABSTRACT

A cracking furnace for thermal cracking of hydrocarbon feedstocks has a central burner provided vertically at the center of the ceiling of a combustion chamber, side burners provided vertically at both sides of the central burner, and reaction tubes vertically arranged between the central burner and resepctive side burners. The reaction tubes are arranged in rows along the longitudinal direction of the chamber and form arch bands at the lower part of the combustion chamber. A combustion gas-inducting duct is provided at the bottom of the chamber, a quenching heat exchanger is provided at the upper part of the chamber, and a reaction tube exit header is provided for connecting a plurality of exits of the reaction tubes to the quenching heat exchanger.

5 Claims, 4 Drawing Sheets

CRACKING FURNACE

BACKGROUND OF THE INVENTION

1. Field of the Invention

This invention relates to a cracking furnace and more particularly it relates to a tubular furnace for thermal cracking of hydrocarbons and like organic feedstocks, especially petroleum hydrocarbons into ethylene, propylene, butadiene, etc.

2. Description of the Related Art

FIG. 4 of the accompanying drawings shows a cross-sectional view of a cracking furnace according to the prior art, FIG. 5 shows a cross-sectional view in the direction of arrow mark along the line V—V of FIG. 4, and FIG. 6 shows a cross-sectional view of a quenching heat exchanger connected by the medium of a header to the exits of the reaction tubes of FIG. 4.

The above apparatus comprises a plurality of reaction tubes 7 provided in a row along the longitudinal direction and at the central part of combustion chamber 1, the reaction tube forming a meander having a bend 8; inlet 21 of an organic feedstock provided at one end of the reaction tube 7; exit 22 of the reaction tube 7 provided at the other end thereof; quenching heat-exchanger 10 united by the medium of header 9 (FIG. 6) to the exit 22 of the reaction tube; reaction tube-suspending fittings 16 suspended from the ceiling of combustion chamber 1 and connected to counterweight 17; convection heat transfer tubes 11 provided at convection heat transfer part 6 communicated to the upper part of the combustion chamber 1 by the medium of connecting duct 5; hearth burners 20 provided vertically at the bottom part of the combustion chamber 1; and wall burners 19 provided on the wall surface of the combustion chamber 1.

In such an apparatus, an organic feedstock is usually mixed with steam; preheated at convection heat transfer part 6; thereafter introduced via reaction inlets into reaction tubes 7; heated by radiation from hearth burners 20 and wall burners 19 to cause pyrolytic reaction; introduced via header 9 into quenching heat exchanger 10; and quenched so that cracked products are obtained without causing excess pyrolytic reaction or polymerization reaction.

In the cracking furnace, when ethylene is produced on the base of 30,000 t/year from naphtha (specific gravity: 0.70), it is necessary to make the length of the cracking furnace around 15 m, and in the case of 50,000 ton/year, 20 m or more of the length is required; thus the site area per ton of naphtha becomes broader. Further, there occurs a drawback that the heat loss from the furnace wall increases. Further, when combustion gas 23 in combustion chamber 1 moves toward convection heat transfer part 6, it is necessary for the gas to traverse reaction tube-suspending fittings 16 so that they are liable to be damaged due to the high temperature gas. Further, since connecting duct 5 connecting combustion chamber 1 to convection heat transfer tube 11 is short when combustion gas having non-uniform temperatures is not yet sufficiently mixed, the gas is introduced into convection heat transfer tubes 11 which usually consist of 4 to 12 passes so that the convection heat transfer tubes 11 corresponding to respective passes are non-uniformly heated, and as a result, the temperatures of the respective passes at the exits of the convection heat transfer tubes are different. Some large difference can be in the amounts to 20 to 50° C.

Ideal reaction tubes have a small pressure-loss; can rise up to a definite temperature within a definite retention time and carry out the maximum treatment of the feedstock per one pass; and can provide as short as possible, a connection length of the exits of the reaction tubes to the inlet of the quenching heat-exchanger by way of header 9. Further, it is desirable from an economical point of view to use a small number of quenching heat exchangers each having a large capacity.

According to the above cracking furnace, however, in order to reduce the number of quenching heat exchangers 10 that are installed, reaction tubes having a complicated bend or a bend of a small bending radius, Y-shaped collecting tubes piece, etc. as shown by the configurations of various reaction tubes of FIG. 8 and FIG. 9 are used. Thus, the smooth flow of the fluid in the furnace is hindered, which cause an increase in the pressure loss and coking. Further, when the configuration of reaction tubes is complicated, there is a drawback that the reaction tubes and bending parts are liable to be damaged due to the occurrence of extraordinary thermal stress under high temperature condition (750° to 1,100° C.). The configuration of the reaction tube of FIG. 5 is very simple, but the quantity of feedstock per one pass is so small that there is a drawback that it is necessary to use a large number of quenching heat exchangers each having a small capacity. For example, in the case where ethylene is produced on the base of 30,000 ton/year from naphtha, it is necessary to provide 16 or more quenching heat exchangers.

SUMMARY OF THE INVENTION

The object of the present invention is to provide a cracking furnace which will shorten the length of cracking furnace, reduce the site area and the surface area of the wall of the cracking furnace, and reduce the number of quenching heat exchangers, thereby making the apparatus compact and lightweight and reducing the damage occurring to the parts of the furnace.

The present invention resides in:

- a cracking furnace for thermal cracking of organic feedstocks, comprising;
- a hollow furnace body:
- a combustion chamber provided in said furnace body;
- a ceiling provided at the upper part of said combustion chamber;
- a central burner provided vertically at the center of the ceiling of said combustion chamber;
- side burners provided vertically at both sides of said central burner, respectively;
- reaction tubes in rows vertically arranged between said central burner and respective side burners, and forming arch bends at the lower part of said combustion chamber;
- a means for feeding the organic feedstocks into said reaction tubes;
- a quenching heat exchanger provided at the upper part of said combustion furnace;
- a reaction tube exit header connecting a plurality of exits of said reaction tubes to said quenching heat exchanger; and
- a combustion gas-inducing duct, provided at the bottom part of the combustion chamber and connected to an exit duct of the combustion gas.

DETAILED DESCRIPTION OF PREFERRED EMBODIMENTS

Figure 3:
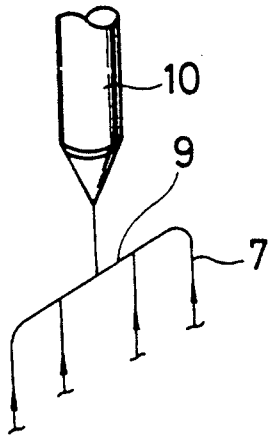
FIG. 3 shows a configuration of a reaction tube exit header of FIG. 1
Figure 4:
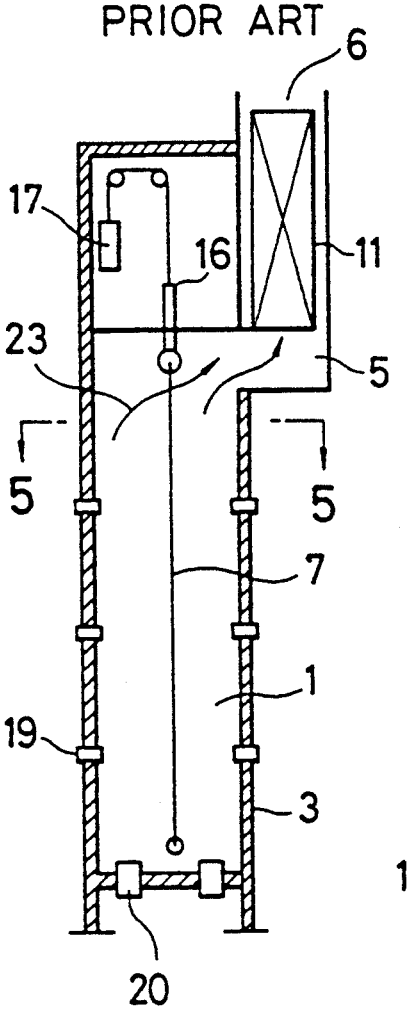
FIG. 4 PRIOR ART
FIG. 4 shows a cross-sectional view of a cracking furnace according to the prior art.
Figure 5:
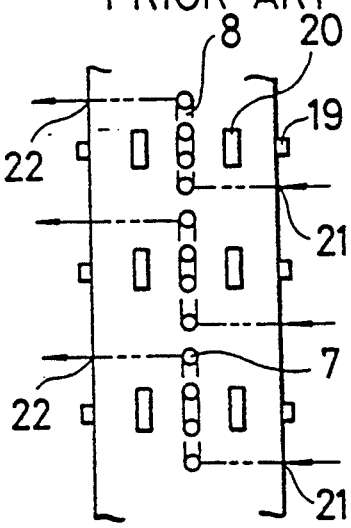
FIG. 5 PRIOR ART
FIG. 5 shows a cross-sectional view in the arrow taken along line V—V line of FIG. 4 (Prior Art).
Figure 6:
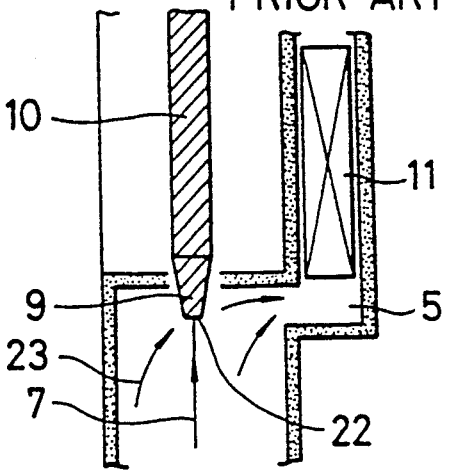
FIG. 6 PRIOR ART
FIG. 6 shows a cross-sectional view of a quenching heat exchanger-connecting part at the exits of the reaction tubes in FIG. 4 (Prior Art).
Figure 7:
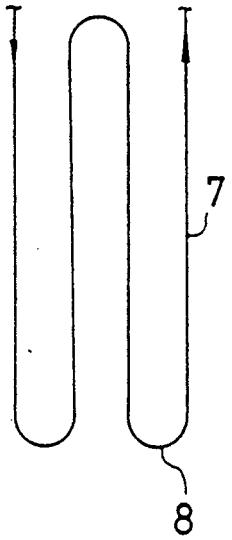
FIG.7 PRIOR ART
FIGS. 7, 8 and 9 show configurations of various reaction tubes according to the prior art.
Figure 8:
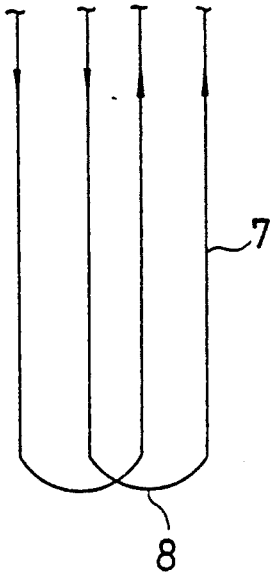
FIG.8 PRIOR ART
Figure 9:
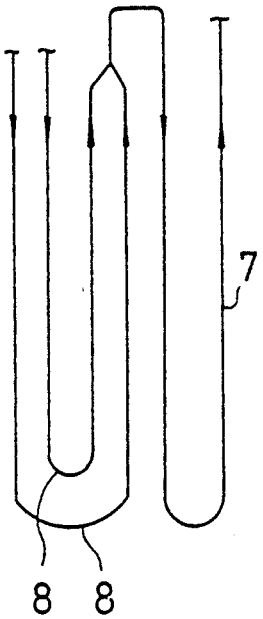
FIG.9 PRIOR ART

The reaction tubes in the present invention are provided vertically on both sides of a central burner, united by the medium of an arch-form bend at the lower part of the combustion chamber, and arranged in a row in the longitudinal direction of the combustion chamber; hence a header connecting the exits of a pluratity of reaction tubes to a quenching heat exchanger can be a short connecting tube having a simple shape (FIG. 3). Thus it is possible to inhibit undesirable reactions of active components produced inside the reaction tubes. Further, it is possible to reduce the number of the quenching heat exchangers installed, and also it is possible to ensure a structural stability due to the reasonable connection of the reaction tubes to the quenching heat exchangers.

Further, in the present invention, since the burners are provided vertically at the ceiling of the combustion chamber, and the convection duct is provided by the medium of a combustion gas-inducing duct at the bottom of the combustion chamber, the combustion gas and the burner flames do not contact the reaction tubes-suspending fittings and the reaction tube exit header. Thus, damage of the above-mentioned parts due to high temperature gas is prevented.

Further, the above-mentioned combustion gas-inducing duct is provided at the central bottom part of the combustion chamber, preferably having a V shape in cross section, whereby thereby paths of combustion gas are formed between the combustion gas-inducing duct and the arch bends of the reaction tubes. Thus, most of the combustion gas flows in a parallel flow path along the wall surface and the reaction tubes so that it is possible to uniformly heat the reaction tubes, while a portion of the combustion gas passes downwardly between the bends of the reaction tubes.

Further, since the combustion gas inducing duct and the connecting duct are provided between the combustion chamber and the exit duct including the convection heat transfer tubes, combustion gas having uneven temperatures is sufficiently mixed before it is introduced into the exit duct so that it is possible to uniformly heat the respective passes of the convection heat transfer tubes.

The present invention will be described in more detail by way of an example.

EXAMPLE

Figure 1:
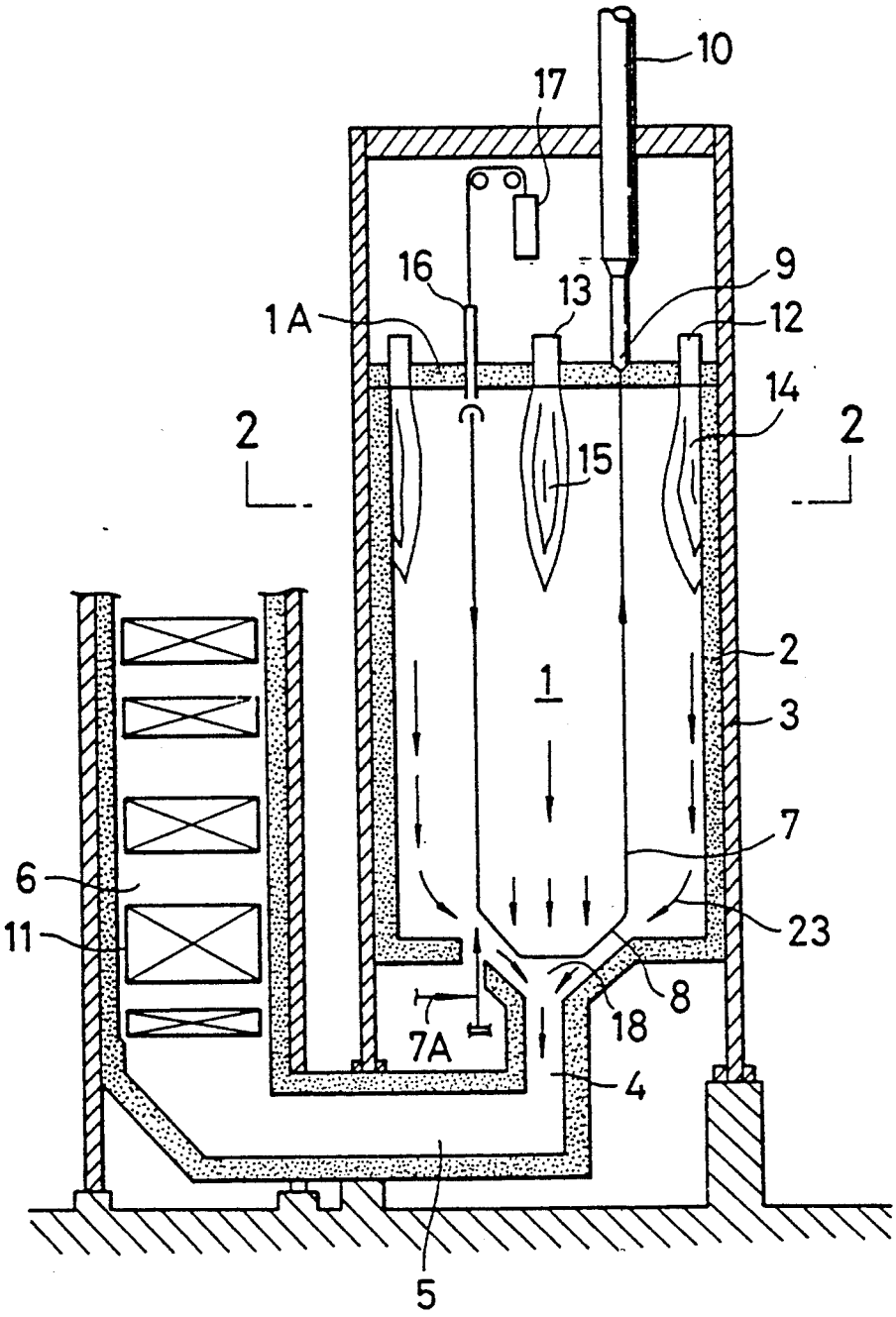
FIG. 1 shows a cross-sectional view of the cracking furnace as an embodiment of the present invention.
Figure 2:
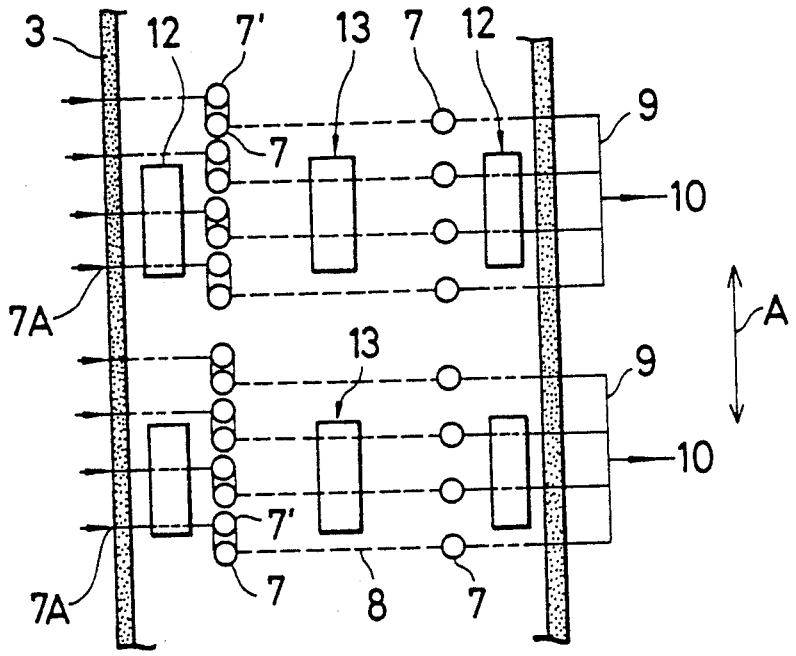
FIG. 2 shows a cross-sectional view in the arrow taken along line 2—2 line of FIG. 1.

FIGS. 1, 2 and 3 illustrate an embodiment of the cracking furnace and parts thereof. This apparatus comprises a hollow furnace body 3; a combustion chamber 1 provided in the furnace body 3; a central burner 13 provided vertically at the center of the ceiling 1A of combustion chamber 1; side burners 12 provided at both sides of the central burner 13; respectively; reaction tubes 7 vertically disposed between said central burner 13 and respective side burners 12, forming arch bends 8 at the lower part of said combustion chamber, and arranged in rows along the longitudinal direction A (FIG. 2) of the furnace body 3 inlet part 7′ of the reaction tube 7 being connected to inlet pipe 7A and being aligned with the row of the rection tubes 7 by means of an ordinal bend; reaction tubes-suspending fittings 16 attached to the ceiling 1A of the combustion chamber for suspending the reaction tubes 7 therefrom; a quenching heat exchanger 10 provided at the upper part of the combustion chamber 1; a reaction tube exit header 9 connecting the exits of reaction tubes 7 (four tubes in this case) to the quenching heat exchanger 10; a V shaped combustion gas-inducing duct 18 provided at the central bottom part of the combustion chamber 1, paths of the combustion gas being formed between the combustion gas-inducing duct 18 and the arch bends 8 of the reaction tubes 7; a vertical inducing duct 4 connected to the combustion gas inducing duct 18; and convection heat transfer tubes 11 provided at an exit duct 6 connected to the vertical inducing duct 4 by the medium of a connection duct 5 and provided at side of the combustion chamber 1. The inside wall of the combustion chamber 1 is covered by a fire resistant wall 2. Reaction tubes-suspending fittings 16 are connected to a counterweight 17. Further, the exits of four reaction tubes 7 are connected to a large capacity quenching heat exchanger 10 by a reaction tube exit header 9, as shown in FIG. 3.

In such an apparatus, a feedstock like naphtha is usually mixed with steam; preheated by passing it through heat transfer tubes 11 at the convection duct 6; fed to reaction tubes 7 and 7′ from an inlet pipe 7A provided at the bottom part of the combustion chamber 1; heated by radiant heat of central burner 13 at the ceiling of combustion chamber 1 and side burners 12 to cause pyrolytic reaction of the feedstock; and introduced from reaction tube exit header 9 into quenching heat exchanger 10 where the resulting pyrolytic gas is quenched.

Combustion gas 23 from central burner 13 and side burners 12 flows along the wall surface in a parallel flow to reaction tubes 7, without traversing reaction tubes-suspending fittings 16 and reaction tube exit heater 9, and passes between tubes of arch bend 8 downwardly or flows along the paths formed between the arch bend 8 and duct 18 at the bottom part of the combustion chamber 1; is led to vertical duct 4; and introduced into exit duct 6 provided with convection transfer tubes 11 via connecting duct 5.

Thus, the reaction tubes-suspending fittings 16 and the reaction tube exit header 9 do not contact the combustion gas 23, and the burners 12 and 13 are arranged at the ceiling; hence the fittings and the header do not contact the respective flames 14 and 15 so that damage of the parts due to high temperature is prevented. Further, since the arch bend 8 is of a simple shape of a large radius as compared to the ordinal bend, the pressure loss at the reaction tubes 7 is small and coking is reduced. Further, while the combustion gas 23 is passed through inducing duct 18, vertical duct 4 and connecting duct 5, the gas is mixed to have a uniform temperature so that uniform heating of feedstock flowing along the respective paths of the convection heat transfer tubes 11 is possible. Furthermore, since the reaction tubes 7 are arranged in the longitudinal direction A of combustion chamber 1 in a row, it is possible to connect the reaction tube exit heater 9 to the quenching heat exchanger 10 in a reasonable and simple form, and also since the connecting tube of header 9 is shortened, it is possible to inhibit undesirable reactions of active components formed inside the reaction tubes and also to ensure the structural stability of the tube.

Table 1 shows comparison of the apparatus of the present invention (Example 1) with conventional apparatus of the same productivity (Comparative example (1) in the aspect of cracking furnace length, cracking furnace site area, cracking furnace wall surface area and cracking furnace weight.

TABLE 1

| | Example 1 | Compar. ex. 1 |
|---|---|---|
| furnace length | 14 m | 20 m |
| furnace site area | 4.8 $m^2$/N-ton | 6.6–8.6 m $m^2$/N-ton |
| furnace wall area | 34.7 $m^2$/N-ton | 50–55 $m^2$/N-ton |
| furnace weight | 22 ton/N-ton | 35–50 ton/N-ton |

(N: raw material naphtha)

As seen from the Table, the apparatus of the present invention is able to make the cracking furnace more compact and lightweight by 30% or more as compared with the conventional apparatus.

According to the present invention, it is possible to reduce the length of the cracking furnace to thereby reduce the site area of the cracking furnace and the wall surface area thereof and also to reasonably reduce the number of quenching heat exchangers so that it is possible to make the apparatus compact and lightweight. Further, since the burners are provided vertically at the ceiling of the furnace and a V-shaped inducing duct is provided at the bottom of the furnace, it is possible to uniformly heat the reaction tubes, in cooperation with reasonable arrangement of burners and reaction tubes. Further, since the arch bend of reaction tubes is of a simple shape, it is possible to reduce the pressure loss and also reduce the coking problem at the bend part.

What we claim is:

1. A cracking furnace for thermal cracking of organic feedstocks, comprising:

a hollow furnace body extending in a longitudinal direction;

a combustion chamber provided in said furnace body;

a combustion gas exit duct communicating with said combustion chamber;

a ceiling provided at an upper part of said combustion chamber;

a central burner provided vertically at the center of the ceiling of said combustion chamber;

side burners provided vertically at both sides of said central burner, respectively;

reaction tubes vertically disposed between said central burner and respective side burners, forming arch bends at a lower part of said combustion chamber, and arranged in vertical rows along the longitudinal direction of the furnace body, wherein said reaction tubes having inlet and outlet ends;

means for feeding the organic feedstock into said reaction tubes through said inlet ends;

a quenching heat exchanger provided above the ceiling at an upper part of said furnace body;

a reaction tube exit header connecting a plurality of outlet ends of said reaction tubes to said quenching heat exchanger; and a combustion gas flow inducing duct provided at the lower part of the combustion chamber and connected to the exit duct for the combustion gas.

2. A cracking furnace according to claim 1, wherein said combustion gas flow inducing duct is V-shaped in cross section.

3. A cracking furnace according to claim 1, wherein said exit duct for the combustion gas is provided with convection heat transfer tubes for preheating the organic feedstock to be fed to said reaction tubes.

4. A cracking furnace according to claim 1, wherein said reaction tubes are suspended by fittings attached to the ceiling of the combustion chamber.

5. A cracking furnace according to claim 1, wherein said central burners, side burners, feeding means, outlet header, quenching heat exchanger and reaction tubes together form a set, and a plurality of said sets being arranged in rows along the longitudinal direction of the furnace body.

* * * * *